US005560600A

United States Patent [19]

FitzSimons et al.

[11] Patent Number: 5,560,600

[45] Date of Patent: Oct. 1, 1996

[54] METHOD FOR AND RACKET TO TEACH TENNIS

[76] Inventors: E. Luke FitzSimons, 709 Catalina St., Laguna Beach, Calif. 92651-2575; Phillip C. Dent, 2129 Vista Entrada, Newport Beach, Calif. 92660

[21] Appl. No.: 369,175

[22] Filed: Jan. 5, 1995

[51] Int. Cl.[6] ..... A63B 49/00; A63B 69/38

[52] U.S. Cl. ..... 273/29 A; 273/73 G

[58] Field of Search ..... 273/73, 29 R, 273/29 A

[56] References Cited

U.S. PATENT DOCUMENTS

| | | | |
|---|---|---|---|
| 335,656 | 2/1886 | Taylor | 273/73 R |
| 3,033,575 | 5/1962 | Hause . | |
| 3,679,205 | 7/1972 | Finkle et al. . | |
| 4,367,871 | 1/1983 | Schiefer . | |
| 4,511,139 | 4/1985 | Armstrong . | |
| 4,746,119 | 5/1988 | Jeanrot | 273/73 G |
| 4,854,585 | 8/1989 | Koch et al. . | |
| 4,915,382 | 4/1990 | Madsen | 273/73 G |
| 5,143,373 | 9/1992 | Meissner . | |
| 5,178,387 | 1/1993 | Kuebler . | |
| 5,178,388 | 1/1993 | Schlenker . | |

FOREIGN PATENT DOCUMENTS

| | | | |
|---|---|---|---|
| 49-24297 | 6/1974 | Japan | 273/73 G |
| 3204 | of 1881 | United Kingdom | 273/73 G |

*Primary Examiner*—Mark S. Graham
*Attorney, Agent, or Firm*—James G. O'Neill

[57] ABSTRACT

A tennis racket is provided with a one-way free hinge adjacent the head of the tennis racket between the handle and the racket head to provide a hinged movement of the head of the racket with relation to the handle when the racket is swung and sufficient centrifugal force is provided to the head to swing it away from the racket with no bias from the hinge means. Additionally, the hinge provides no bias to force or bring the head back to the integral or aligned position with the handle, so that only when an improper swing of the racket occurs to apply centrifugal force to the head, will the head swing relative to the handle thereof. The racket enables a tennis player to be taught or to practice swinging a tennis racket with the proper "lag" and follow through so that the tennis player feels the correct rhythm and timing when stroking through a swing.

11 Claims, 2 Drawing Sheets

METHOD FOR AND RACKET TO TEACH TENNIS

BACKGROUND OF THE INVENTION

1. Field of the Invention

This invention relates generally to tennis teaching aids and, more particularly, to an improved method for and an improved racket to teach tennis.

2. Description of Related Art

As is well known, the basic strokes used in tennis are the forehand and the backhand. A forehand stroke is one in which the ball is met by the player on the racket-hand side of the body, whereas the more difficult backhand stroke requires a player to extend the racket hand across the player's body while the player's body is turned partly away from the ball. Many attempts have been made to acceptedly teach a player to swing a tennis racket so as to correctly hit the ball using the two above-mentioned basic strokes, as well as other types of strokes.

The preferred swing of a tennis racket requires the racket to be in motion and the wrist of a player to be in a certain position so that the momentum of the head of the tennis racket properly moves a tennis ball. Tennis instructors are always seeking ways to successfully pass on the required skills to other players, whether such players be novices or professionals. In particular, there still exists a need in the art to enable an instructor to teach the proper use of a tennis racket when hitting a tennis ball using various strokes such as a forehand, one- or two-handed backhand, overhead and a serve.

Since it is hard, or practically impossible, to teach the kinesthetic or muscular sense which must be developed to properly use a tennis racket to stroke a ball, as opposed to pushing it, many attempts have been made to provide a tennis racket which will aid in properly developing the various tennis strokes of a player, and which racket enables a tennis instructor to more easily teach a player the proper use of the racket.

A prior art device for teaching the use of a tennis racket to a student is shown in U.S. Pat. No. 3,679,205, to Finkle et al, which discloses a tennis racket provided with a hinge intermediate the handle and the racket head. The hinge is provided with a bias means which tends to maintain the racket handle and head in a normal linear relation. However, this hinge will break down when the racket is used to push a tennis ball so that the racket head and handle is used as a lever to propel the ball. Furthermore, this patent discloses means for completely locking the hinge, intermediate the handle and head so as to also enable the racket to be used to play tennis.

A further tennis training racket or device is shown in U.S. Pat. No. 4,367,871 to Schiefer, which discloses a tennis racket having an elongated handle and a head with a device connecting the handle and the head to allow free relative pivotal movement between the head and the handle, in either direction.

U.S. Pat. No. 5,143,373 to Meissner discloses a further tennis racket having a head with a face lying in a facial plane and a shaft fixed to and co-planar with the head. The racket also has a handle connected to the head with a flexible device located at least partly within the handle and flexibly coupling the handle and the shaft. The head is relatively displacible in either direction along a direction remaining perpendicular to the facial plane and co-planar with the handle to enable the racket to aid in correcting the swing of a player using the same.

U.S. Pat. Nos. 5,178,387 and 5,178,388 disclose tennis rackets having a flexible throat region between the handle and the racket head, and a racket head with a separable support frame in which the head and frame are hingedly connected together by joints such that a local rotation of both frames relative to each other is allowed at the points of articulation.

Finally, U.S. Pat. No. 3,033,575 to Hause, U.S. Pat. No. 4,511,139 to Armstrong, and U.S. Pat. No. 4,854,585 to Koch et al show practice golf clubs and a baseball bat having hinges to help teach the user of the golf club or baseball bat to better control the swing of the device.

With the ever increasing popularity of tennis in which both the amateur and professional players of all countries join in various contract enterprises and open tournaments, both novice and professional players are continually looking for new methods and/or processes or devices which enable them to enhance their tennis playing activities.

Although the known devices shown in the prior art solve some of the problems with teaching tennis strokes to novices, it has been found that none of the available devices or methods for teaching tennis solve all the known problems, or enable an instructor to properly teach either a novice or a professional how to properly stroke the ball in all positions for all types of shots. In particular, it has been found that it is practically impossible to teach or relate to a person the required delay or "lag" in the snapping of a players wrist, that is necessary to learn the proper rhythm and timing for the ground strokes used in tennis. "Lag" is herein defined as the delay or time a racket head trails the movement of the wrist of a player and then, in a single movement, the player's wrist moves the racket head so that it catches up to and becomes parallel with the wrist. This lag, or moment when the racket head catches up with the wrist of the player should also coincide with the exact moment when the racket hits a tennis ball. Lag, therefore, is considered to be an essential element in providing correct technique including timing and rhythm when stroking a tennis ball so as to provide the necessary power to play tennis, particularly in a competitive environment.

SUMMARY OF THE INVENTION

Accordingly, it is a general object of the present invention to provide an improved racket for learning tennis. It is a more particular object of the present invention to provide a tennis racket that teaches lag and the timing of lag in learning the groundstrokes used in tennis. It is the further object of the present invention to teach timing and rhythm to a tennis player by use of the racket of the present invention. It is yet another object of the present invention to provide a hinged tennis racket for use in teaching a player how to hit "up through" a tennis ball, so as to give a top spin to the ball. It is still a further object of the present invention to provide a unique device and method to enable an instructor to teach the correct technique of stroking a tennis ball. It is yet another particular object of the present invention to provide a hinged tennis racket and method using the same to enable a tennis player to practice the correct technique and rhythm for stroking a tennis ball. It is still yet a further particular object of the present invention to provide a device and method for teaching the correct technique and rhythm for the various strokes in tennis. And, it is a still further object of the present invention to provide an improved tennis racket having a free hinge that acts in one direction only, with no bias so as to enable the teaching of the proper strokes in tennis.

In accordance with the present invention, there is provided a novel and unique hinged tennis racket in which the head is designed to break down or move with respect to the handle if not used properly so as to enable an instructor to properly teach lag when swinging the racket. The hinge is a free hinge which opens in one direction only, and which has no bias in either the opening or closing direction. Utilizing the racket of the present invention having a specific breakpoint, a student or professional may practice, or be taught the proper method of swinging a tennis racket to properly stroke a tennis ball.

BRIEF DESCRIPTION OF THE DRAWINGS

The objects and features of the present invention, which are believed to be novel, are set forth in particularity in the appended claims. The present invention, both as to its organization and manner of operation, together with further objectives and advantages, may best be understood by reference to the following description, taken in connection with the accompanying drawings, in which:

DESCRIPTION OF THE PREFERRED EMBODIMENTS

Figure 1:
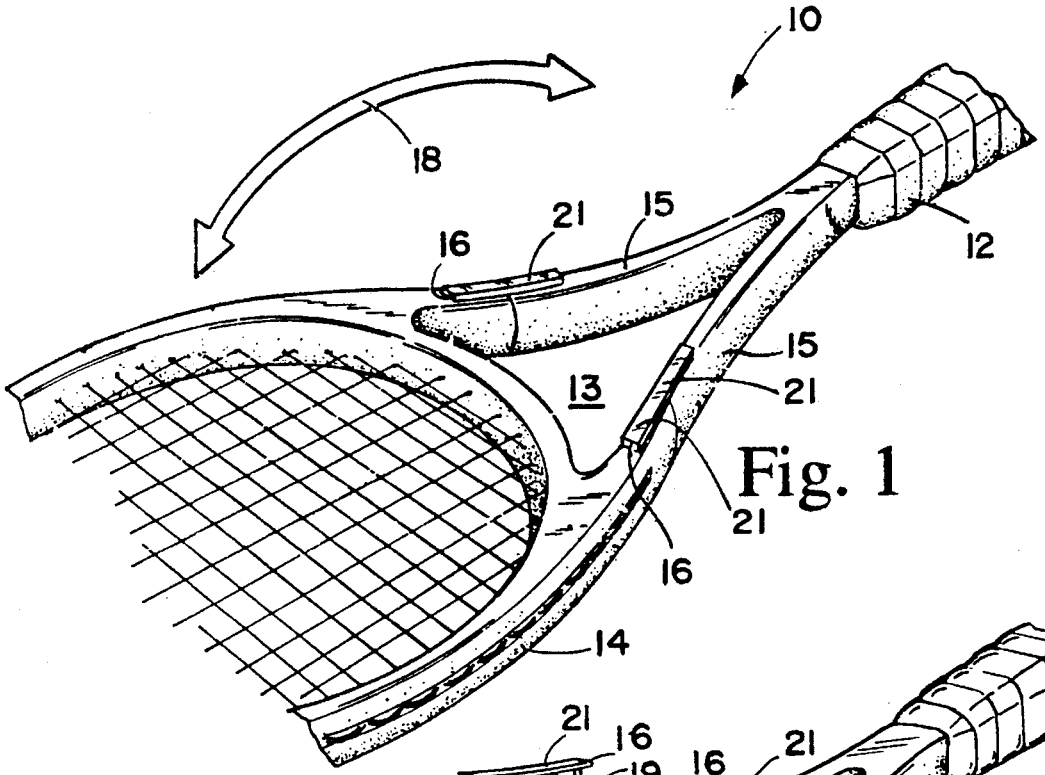
FIG. 1 is a partial top isometric view of an improved hinged tennis racket of the present invention in the closed position.
Figure 2:
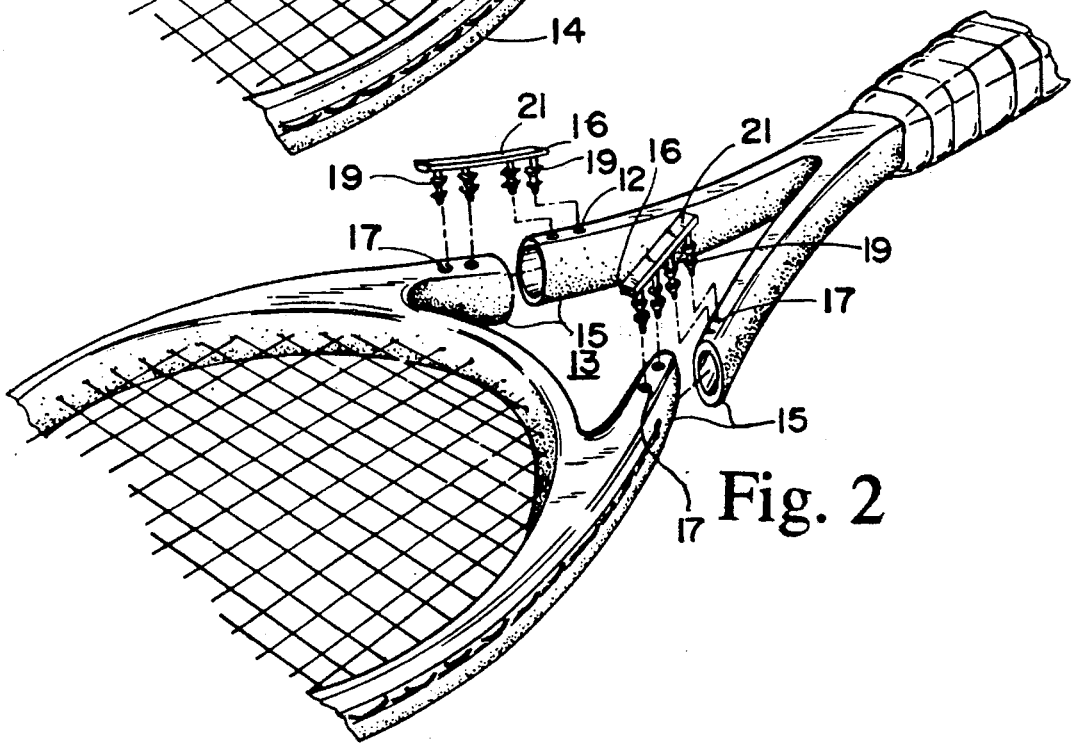
FIG. 2 is a further partial top isometric, exploded view of the tennis racket of FIG. 1 with the hinged portions thereof removed.
Figure 3:
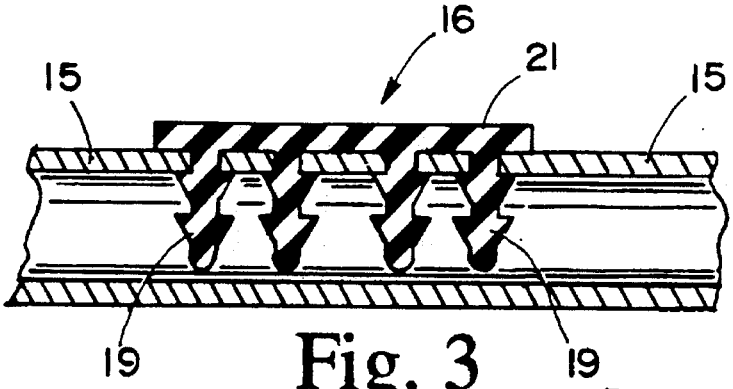
FIG. 3 is a partial sectional, enlarged view through one of the hinge elements in the tennis racket of FIG. 1.
Figure 4:
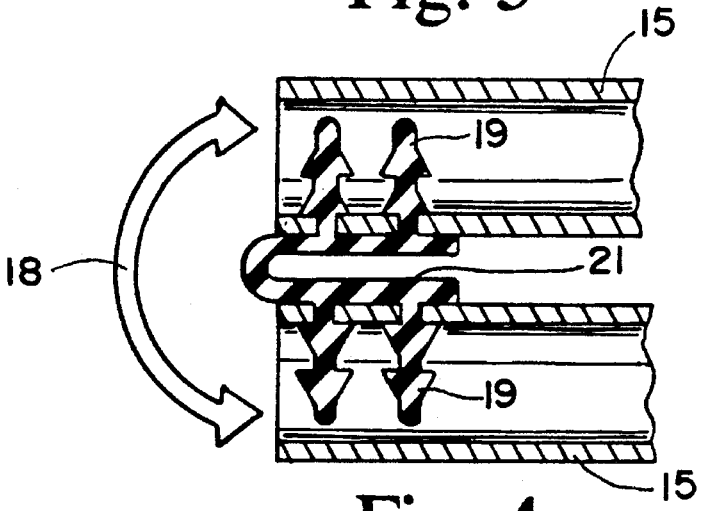
FIG. 4 shows the hinge element of FIG. 3 in the completely open or broken-down position.

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for a novel hinged, tennis racket to aid in teaching and/or for practicing the proper strokes of tennis. This collapsible or hinged racket enables the unique method steps of the present invention to be practiced and taught so as to improve the tennis playing capabilities of either novice or professional players utilizing the same.

Turning now to the figures of the drawings, there shown is a novel collapsible or hinged tennis racket 10 formed in accordance with the teaching of the present invention. The tennis racket includes an elongated handle 12 and a head 14 and is preferably formed from conventional materials such as graphite or graphite composites. The racket is cut along a pair of tines 15 at a throat portion 13 and includes a plurality of openings 17 drilled or formed in the tines so as to enable substantially flat hinge means 16 to be connected to the cut tine portions 15 at the throat 13. The hinge means 16 may take any desired form, but preferably has a plurality of integral leg means 19 extending from one side thereof which fit into and are fixedly connected to the openings 17 in the racket. The substantially flat hinge means 16 may be provided with a weakened portion, such as a cut line or the like, and may be formed from a plastic, or other types of resilient materials so as to provide a substantially long-lived, free hinge that provides no resistance or bias in either the opening or closing direction when the head 14 moves relative to the handle 12, as shown by arrow 18.

The hinges are streamlined or flat on one side 21, and fit close to the tines 15 of the racket, with the flat surface on the outside thereof with the integral leg means on the other, secured in the opening 17, so as to only enable the racket head 14 to rotate or open with respect to the handle in one direction (as shown by arrow 18).

When a player utilizes the racket 10 of the present invention, the opening thereof, also called the break point, caused by the hinged means 16 thereon, enables a tennis instructor to properly teach the correct method of swinging a racket so as to correctly perform the various types of tennis strokes. In addition, this racket may be used by a player to practice the proper stroking actions.

Figure 5:
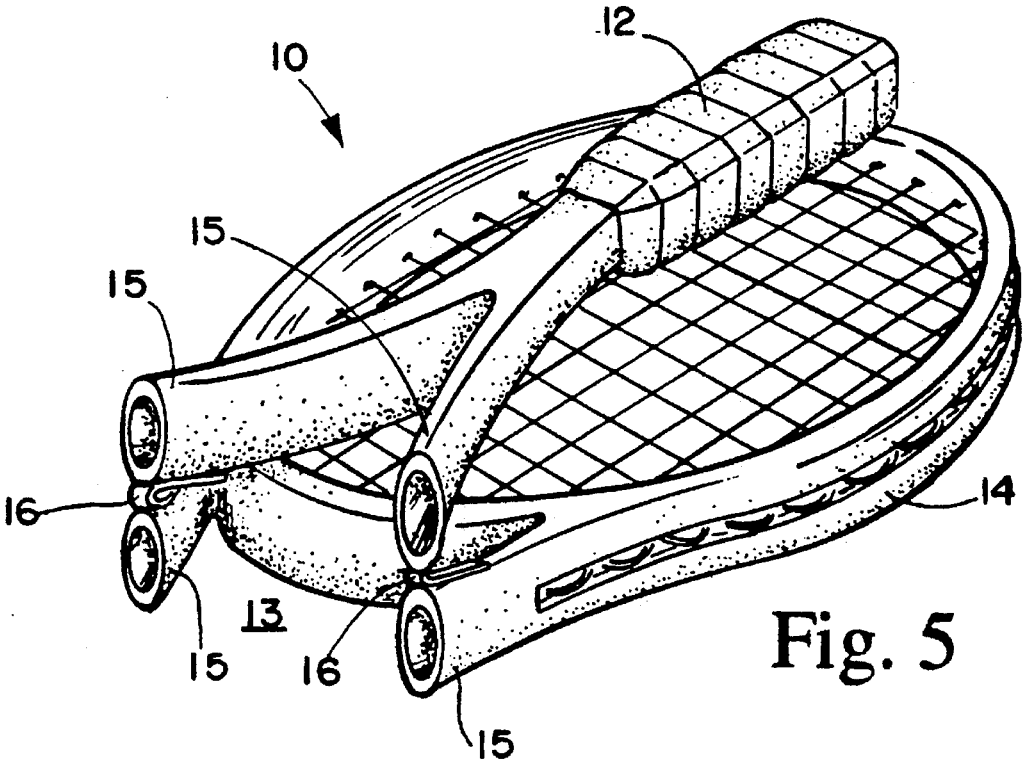
FIG. 5 is an isometric view of the improved hinged tennis racket of the present invention in the open or folded position.

The improved method of the present invention is used in teaching a player the proper swinging of a tennis racket for any desired stroke. When teaching the forehand stroke the racket 10 of the present invention is used to teach a player how to strike the ball with the correct timing and rhythm, as follows: that is, this racket forces the player to set his/her wrist in the correct position necessary for "lag" to occur. The player should start the forehand stroke with the racket in a partially or fully broken or open position (see FIG. 5), as the player begins the stroke, the racket 10 should close to the position shown in FIG. 1, due to the centrifugal force of the swing. With the racket in the closed position, the player will then have the sensation or "feel" that the racket is solid as the player continues to travel through this swing. For this solid feel to occur, proper lag must have occurred. Moreover, it is important to teach that the timing of the closure of the racket to its fully closed position coincides with the timing of hitting a tennis ball. That is, although usually no tennis ball is used when teaching a player how to use the racket of the present invention, the closing of the racket, specifically the rhythm and timing thereof as the player goes through the swing, teaches the player how the racket should feel when properly hitting a tennis ball. For example, when using a conventional non-hinged racket the racket must feel solid at impact with the tennis ball. This solid feeling cannot be taught by the use of any other known racket. However, with the racket of the present invention, the player learns that the racket should maintain its integrity, that is, be in a solid, closed position when hitting through the ball in a forehand shot. Furthermore, the racket must stay in this closed position through the rest of the swing. This will teach the player how to correctly follow through after the ball is struck. This racket and method of teaching, teaches the correct timing and rhythm of such a stroke, including follow through. If, however, the follow through of the player is incomplete or incorrect, the racket will break down, i.e., the head will swing away from the handle, indicating that a technical mistake has been made in the swing. The instructor and player, or the player alone may work with the racket of the present invention to hold it and stroke it in the proper method so that the racket always stays closed, with no movement of the head with respect to the handle around the hinge means 16.

When using the racket 10 to teach the correct technique for a one-handed backhand, the racket of the present invention aids in teaching the correct "lag", i.e., wrist movement and placement of the racket through hitting the ball and the follow through of the one-handed backhand. This is accomplished by showing as well as allowing the player to feel that when the racket is taken back at the start of the swing, the racket should remain closed, with no breaks, i.e., the head and handle should be aligned in the closed position. Then, as the racket is swung forward, i.e., normally toward the ball, the racket will be allowed to first open slightly and then close, giving the player the feel or sense of hitting the ball. After hitting the ball, the player should complete the follow through of the swing so that the racket, when it is brought to the end of the stroke and held, will be allowed to collapse (open).

When teaching a two-handed backhand using the racket of the present invention, the same steps as set forth above in teaching the forehand should be followed.

To teach a player how to correctly serve utilizing the racket of the present invention, the racket again is used to teach the correct technique, that is timing and rhythm of the serve. This is accomplished by instructing the player to hold the racket at the player's side, at the beginning of the serve. The hinge means 16 on the racket should be positioned on the outside of the racket, away from the body of the server. The racket is then swung back, away from the body, in a manner that prevents the racket from collapsing (opening), i.e., to ensure that the racket remains closed with the head and handle in the aligned position. The player is then taught that at the full take-back, i.e., the back end of the stroke, the tip of the racket should point vertically toward the sky, or at a slight angle or tilt slightly over the head of the player. When swinging the racket to its full rear position, above the body of the server, the racket should always be maintained in the closed position with the handle and the head of the racket aligned, with no break or no separation therebetween. To complete the serve, the player is then taught to bring the racket down behind their back and then stretch out or up to hit the ball. Again, throughout this swinging movement, the racket must be maintained in its closed or integral position through the wrist snap (i.e., hitting of the ball) and entirely through the follow through. At no time during the serve should the racket be allowed to collapse or break down. If at any time the racket collapses or starts to break down, the player will immediately know that they are not utilizing the racket correctly and that their swing during the serve is incorrect. This enables a novice player to get the "feel" of how to properly utilize a racket when serving a tennis ball, or to enable a professional to correct any improper habits in their serve.

Finally, when utilizing the racket of the present invention to teach a player the proper technique for an overhead swing, the player is taught to hold the racket vertically behind the player's head, exactly as stated above, in connection with the serve. The racket is then looped down behind the back of the player and then the wrist is snapped up through where the ball would be hit, while always maintaining the racket in its closed or integral position, and not allowing any break or tendency of the racket head to rotate around the hinge means to occur.

Therefore, it can be seen that the uniquely hinged tennis racket of the present invention provides a novel device to allow a tennis player to properly train with or be properly taught the basic strokes of tennis, whether such player is a novice or professional. The racket of the present invention may also be used to enable a seasoned player having problems with any strokes in their game to correct such strokes by utilizing the correct technique and timing taught by using this racket and the method herein disclosed.

Those skilled in the art will appreciate that various adaptations and modifications of the just-described preferred embodiments can be configured without departing from the scope and spirit of the invention. Therefore, it is to be understand that, within the scope of the appended claims, the invention may be practiced other than as specifically described herein.

What is claimed is:

1. A tennis racket for teaching a person the correct technique to stroke a tennis ball, comprising a racket head and a substantially straight racket handle connected to said racket head at a throat region by a pair of tines having two sides;

two separate hinge means having a substantially flat upper surface and a lower surface;

each of said two separate hinge means being secured by said lower surface thereof to a respective one of said pair of tines on one same side at said throat region, between said racket head and said substantially straight racket handle, for pivotally connecting said racket head and said substantially straight racket handle together so as to permit free pivotal movement of said racquet head relative to said substantially straight racquet handle in only one direction, from a closed, aligned position to an open, unaligned position and back, when said tennis racquet is swung; and each of said two separate hinge means having no bias when said racquet head is pivoting between said closed, aligned position and said open, unaligned position.

2. The tennis racket of claim 1 wherein said pair of tines include a plurality of openings formed therein, and said two separate hinge means include extending means from said lower surface thereof, which extending means are fixedly secured in said plurality of openings to pivotally hold said racket head and said substantially straight racket handle together.

3. A method for a person to learn the correct technique to stroke a tennis ball, comprising the steps of:

selecting a pivotal tennis racquet having a live hinge means between a racquet head and a racquet handle, which live hinge means allows said racquet head to freely pivot with respect to said racquet handle in one direction only, without bias, from a closed position where said racquet head and said racquet handle are together in alignment with each other, to an open position where said racquet head has pivoted out of alignment with said racquet handle, and back to said closed position;

holding the selected pivotal tennis racquet in a dominant hand normally used to play tennis;

swinging said selected pivotal tennis racquet rearwardly, to a rear position with respect to said person's body, to start a stroke from said rear position;

swinging said selected pivotal tennis racquet forward from said rear position, toward an imaginary striking point in front of said person's body where said racquet head would meet a tennis ball, in such a manner that said racquet head and said racquet handle are in the closed position when they arrive at said imaginary striking point, so as to produce a solid feel as if striking a tennis ball; and following through with the swing of said selected pivotal tennis racquet from said imaginary striking point until said swing is completed over a shoulder of said person's body.

4. The method of claim 3, including the further steps of allowing said selected pivotal tennis racquet to pivot to the open position in said rear position, and then swinging said selected pivotal tennis racquet forward from said rear position, toward said imaginary striking point in such a manner that said racquet head is pivoted to said closed position when said selected pivotal tennis racquet reaches said imaginary striking point, and following through with said swing until said pivotal tennis racquet reaches an end position over the shoulder of said person's body with said racquet head having continuously remained in the closed position from said imaginary striking point to said end position.

5. The method of claim 4 wherein said stroke being learned is a forehand stroke.

6. The method of claim 4 wherein said stroke being learned is a one handed backhand stroke.

7. The method of claim 3, including the further steps of keeping said pivotal tennis racquet in said closed position when in said rear position and swinging said selected pivotal tennis racquet forward from said rear position in such a manner that it first opens slightly and then moves back to said closed position when said selected pivotal tennis racquet reaches said imaginary striking point, following through the swing until said selected pivotal tennis racquet reaches an end position over the shoulder of said person's body, with said racquet head having continuously remained in the closed position from said imaginary striking point to said end position, and holding said selected pivotal tennis racquet in said end position until said racquet head pivots to the open position.

8. The method of claim 7 wherein said stroke being learned is a two handed backhand stroke.

9. A method for a person to learn the correct technique to stroke a tennis ball, comprising the steps of:

selecting a pivotal tennis racquet having a live hinge means between a racquet head and a racquet handle, which live hinge means allows said racquet head to freely pivot with respect to said racquet handle in one direction only, without bias, from a closed position where said racquet head and said racquet handle are together in alignment with each other, to an open position where said racquet head has pivoted out of alignment with said racquet handle, and back to said closed position;

holding the selected pivotal tennis racquet in a dominant hand normally used to play tennis;

moving said selected pivotal tennis racquet to said person's dominant side to start a swing, with said live hinge means on the outside of said selected pivotal tennis racquet, away from said person's body, and said selected pivotal tennis racquet in said closed position;

swinging said selected pivotal tennis racquet rearwardly, away from said person's dominate side, to a full take-back position, until said racquet head points vertically upwards, away from said person toward the sky, while continuously maintaining said selected pivotal tennis racquet in said closed position, while at the same time moving the other, nondominant hand so that it also points upwardly, toward the sky;

swinging said selected pivotal tennis racquet in a looping manner behind the back, and then forward toward an imaginary striking point in front of said person's body where said racquet head would meet a tennis ball at the maximum height that can be attained by said dominant hand, above the sky-pointing non-dominant hand, while continuously maintaining said selected practice racquet in said closed position, except just prior to reaching said imaginary striking point allowing said racket head to partially open and to then close at said imaginary striking point, so as to produce a solid feel at said imaginary striking point as if striking a tennis ball; and following through with the swing from said imaginary striking point so that said swing moves across said person's body toward said person's non-dominant side until said selected pivotal tennis racquet stops in a position pointing rearwardly, at approximately a 45 degree angle, while continuously maintaining said selected pivotal tennis racquet in said closed position.

10. The method of claim 9 wherein said stroke being learned is a serve.

11. The method of claim 9 wherein said stroke being learned is an overhead stroke.

* * * * *